US007188561B1

(12) United States Patent
Kelbly

(10) Patent No.: US 7,188,561 B1
(45) Date of Patent: Mar. 13, 2007

(54) ADJUSTABLE FIREARM TRIGGER MECHANISM AND METHOD OF ADJUSTMENT

(76) Inventor: George E. Kelbly, 7222 Dalton Fox Lake Rd., North Lawrence, OH (US) 44666-9507

( * ) Notice: Subject to any disclaimer, the term of this patent is extended or adjusted under 35 U.S.C. 154(b) by 93 days.

(21) Appl. No.: 11/296,401

(22) Filed: Dec. 8, 2005

(51) Int. Cl.
*F41A 19/16* (2006.01)

(52) U.S. Cl. ..... 89/136; 42/69.02

(58) Field of Classification Search ..... 89/136, 89/27.11, 129.02, 130, 131; 42/76.01, 76.02
See application file for complete search history.

(56) References Cited

U.S. PATENT DOCUMENTS

| | | | | |
|---|---|---|---|---|
| 2,156,191 | A | 4/1939 | Pike | |
| 2,331,405 | A | 10/1943 | Loomis | |
| 3,899,845 | A * | 8/1975 | Wild et al. | 42/69.01 |
| 4,005,540 | A | 2/1977 | Robinson | |
| 4,671,005 | A | 6/1987 | Jewell | 42/69.02 |
| 5,018,292 | A | 5/1991 | West | 42/69.02 |
| 5,187,312 | A | 2/1993 | Osborne | 42/69.01 |
| D364,207 | S | 11/1995 | Tuomey | D22/108 |
| 5,487,233 | A | 1/1996 | Jewell | 42/69.01 |
| 5,718,073 | A | 2/1998 | Sachse et al. | 42/51 |
| D399,914 | S | 10/1998 | Walker | D22/108 |
| 5,857,280 | A | 1/1999 | Jewell | 42/69.03 |
| 5,924,231 | A | 7/1999 | Kidd | 42/69.03 |
| 6,131,324 | A | 10/2000 | Jewell | 42/69.03 |
| 6,681,511 | B1 | 1/2004 | Huber | 42/69.01 |
| 2005/0183311 | A1 | 8/2005 | Diaz et al. | 42/69.01 |
| 2005/0188580 | A1 | 9/2005 | Jewell | 42/69.02 |

FOREIGN PATENT DOCUMENTS

| | | |
|---|---|---|
| DE | 4 125 148 A1 | 2/1993 |
| WO | WO 92-16811 A1 | 10/1992 |

OTHER PUBLICATIONS

"AR-15 Adjustable Trigger Kit", Brownells, http://www.brownells.com/aspx/NS/Store/ProductDetail.aspx?p=7585&title=AR-15+Adjustable+Trigger+Kit, 2 pages printed from the Internet on Oct. 26, 2005.

* cited by examiner

*Primary Examiner*—Stephen M. Johnson
(74) *Attorney, Agent, or Firm*—Richard C. Litman

(57) ABSTRACT

The adjustable firearm trigger mechanism and method of adjustment includes a firing pin block bar, a pivotally trigger shoe, and a link mechanism interconnecting the trigger shoe and the firing pin block bar. The link mechanism includes a sear bar coupled to the trigger shoe for rotation upon pivotal movement of the trigger shoe, and a push rod slidably disposed in one of a plurality of user selectable push rod holes in the trigger housing between a first pivoting end of the sear bar and the firing pin block bar. A trigger pull adjustment assembly is disposed between a second pivoting end of the sear bar and the trigger housing includes a trigger pull adjustment screw mounted in a threaded passage of the trigger housing, and a sear bar return spring abutting the trigger pull adjustment screw and inserted in a portion of the threaded passage of the trigger housing.

8 Claims, 4 Drawing Sheets

ADJUSTABLE FIREARM TRIGGER MECHANISM AND METHOD OF ADJUSTMENT

BACKGROUND OF THE INVENTION

1. Field of the Invention

This invention relates to a trigger assembly for firearms which is easily adjustable for military, hunting, and competition shooting and which is both safe and efficient in operation.

2. Description of the Related Art

Over the past several centuries, a variety of trigger mechanisms have been devised for many different types of firearms and for different applications. Typically in military and hunting applications, trigger mechanisms are designed with emphasis on durability and reliability; consequently, such trigger mechanisms often have heavy trigger pull forces associated with firing the weapon. However, a heavy trigger pull forces degrades consistent accuracy and is particularly undesirable in competition shooting. Heavy trigger pull forces can result in instability of the firearm and also can fractionally delay discharge from the instant desired. It is necessary, of course, to have some trigger pull force to give the shooter feel and control of the firing process.

Those skilled in the art will appreciate that the desired trigger pull force is dependent upon type of firearm, application, and individual preference. An individual shooter might desire a medium to heavy trigger pull force when hunting, and a somewhat light trigger pull force for competition shooting. Further, a competition shooter might have a personal preference for a trigger pull force from two to twenty ounces.

For example, in typical Mauser-type bolt-action rifles, a striker or cocking piece is held in the cocked position by a sear, with the sear in turn supported by a trigger piece. The metal surface interface between the cocking piece and sear carries the main spring load. Of course, there is a large frictional force associated between the meeting of these two metal surfaces. Typical adjustments to the trigger to lighten or vary the trigger pull force include adjusting the trigger spring or reducing to a minimum the mating surface area contact between the cocking piece and the sear.

Another method of reducing trigger pull force is the so-called "multiple-lever" approach. For example, in the Remington "2-ounce" trigger, a third lever is interposed between the trigger piece and the sear to reduce the contact load carried by the trigger piece. In this arrangement, the mating surface between the cocking piece and the sear carries the large (about 25 pounds) mainspring load, while the mating area between the cocking piece and third lever carries a substantially reduced load.

Another difficulty with typical trigger mechanisms is that they are either not adjustable, or only adjustable over a narrow range of trigger pull forces.

Thus, it would be a significant advance in the art if a trigger assembly were devised which allowed for adjustment of trigger pull forces over a wide range to accommodate both hunting, military, and competition shooting. Further, it would be an advance if such a trigger assembly were adjustable to individual preference.

Thus an adjustable firearm trigger mechanism solving the aforementioned problems is desired.

SUMMARY OF THE INVENTION

The adjustable firearm trigger mechanism in accordance with the present invention generally solves the problems outlined above. That is, the trigger assembly hereof is easily adjustable over a wide range of trigger pull forces.

The trigger assembly hereof is externally adjustable allowing for adjustments to the trigger operation without removal of the trigger assembly from the firearm. The trigger assembly hereof is particularly adaptable for use in a Mauser, bolt-action rifle, it being understood that the trigger assembly can be easily modified for use with other types of firearms.

Generally speaking, a Mauser bolt-action rifle includes a cocking piece or striker interconnected to the firing pin mechanism. The trigger assembly hereof includes a firing pin block bar, a pivotally trigger shoe, and a link mechanism interconnecting the trigger shoe and the firing pin block bar. The link mechanism includes a sear bar coupled to the trigger shoe for rotation upon pivotal movement of the trigger shoe, and a push rod slidably disposed in one of a plurality of user selectable push rod holes in the trigger housing between a first pivoting end of the sear bar and the firing pin block bar. A trigger pull adjustment assembly is disposed between a second pivoting end of the sear bar and the trigger housing includes a trigger pull adjustment screw mounted in a threaded passage of the trigger housing, and a sear bar return spring abutting the trigger pull adjustment screw and inserted in a portion of the threaded passage of the trigger housing.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention presents a novel trigger assembly for firearms which is externally and also in turn only adjustable to change trigger pull forces and locked time for both hunting and competition shooting. Since all modern bolt action rifles are basically the 1898 Mauser type design, this trigger assembly can easily be adapted to work in almost all Mauser type bolt action firearms.

The adjustable trigger of the present invention is an adaptation of the basic three lever design. The basic three lever design comprises a trigger shoe, a firing pin block bar and an interconnecting sear bar. The present invention modifies the interconnecting sear bar so that it can be adjusted to change the trigger pull force on the trigger shoe, and the lock time of the firing pin block bar. The lock time is typically the time it takes for the firing pin block bar to release the firing pin cocking piece after the trigger shoe has been pulled.

Figure 1A:
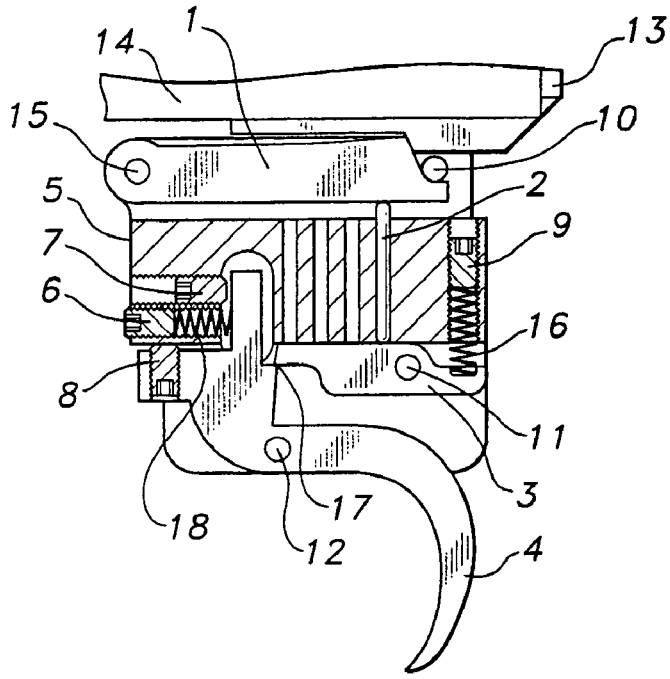
FIG. 1A is side sectional view of an adjustable firearm trigger mechanism according to the present invention in a first configuration with the firing pin in a cocked position.

FIG. 1A shows the adjustable trigger assembly of the present invention. Firing pin block bar 1 is pivotally attached to the trigger housing 5 via a forward action at trigger pin 15. In a cocked position, firing pin block bar 1 abuts a rear action trigger pin 10 in an upwardly rotated position. A rear upper edge of firing pin the block bar 1 engages a corresponding section of firing pin cocking piece 13 attached to the rifle action bolt body of 14. In this position, the firing pin block bar releasably retains the firing pin cocking piece δ 3 from moving in a leftward direction to therefore strike the primer of the ammunition.

A trigger shoe 4 is pivotally attached to the trigger housing a 5 at trigger shoe pivot pin δ 2. Trigger shoe 4 may be adjusted by a trigger shoe over travel adjusting screw 7 and trigger shoe return spring 18, a trigger pull adjustment screw 6 and a sear engagement adjustment screw 8. Trigger shoe 4 contacts an engagement point 17 on a rocker arm type sear bar 3. Sear bar 3 rotates about the trigger housing 5 via a sear bar pivot pin 11.

Sear bar 3 is biased on a first pivoting end to a return position by a sear bar return spring 16 partially housed in a threaded passageway in trigger housing 5 and compressed by a trigger pull adjusting screw 9.

The second pivoting end of sear bar 3 is in contact with a push rod 2 housed in one of a plurality of push rod passageways (A, B, C & D) formed in said trigger housing 5. The push rod 2 communicates through one of the passageways A–D to contact the underside of the firing pin block bar 1.

Figure 1B:
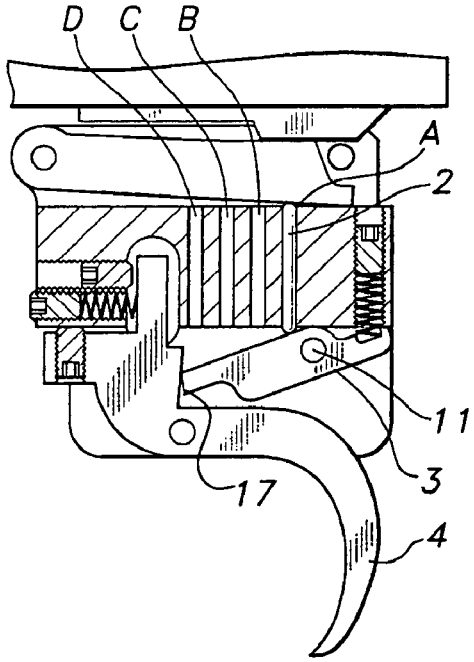
FIG. 1B is side sectional view of an adjustable firearm trigger mechanism according to the present invention in a first configuration with the firing pin in a discharged position.

When the trigger shoe 4 is pulled so that it rotates about trigger shoe pivot pin 12, the sear bar engagement point 17 is released from trigger shoe 4, thereby causing the sear bar 3 to rotate in a counterclockwise direction about sear bar pivot point 11. See FIG. 1B. As sear bar 3 drops, push rod 2 slides down in push rod hole A thereby causing firing pin block bar 1 to rotate in a clockwise direction about forward action trigger pin 15. Firing pin block bar 1 turbine releases firing pin cocking piece 13 to move in a leftward direction.

The lock time of the present invention is adjustable by means of a user placing push rod 2 into one of the plurality of push rod holes A, B, C & D. Since the lock time is defined as the time between the firing shoe 4 initially disengaging sear bar 3 and the firing pin block bar 1 releasing firing pin cocking piece 13, any reduction in the length of travel of any member of the linkage between trigger shoe 4 and firing pin the block bar 1 will reduce the lock time. When push rod 2 is located in push rod hole A, sear bar 3 must rotate the greatest amount before the firing pin block bar 1 can release firing pin cocking piece 13. This is due to the geometric relationship of push rod 2 contacting sear bar 3 at a point closest to sear bar pivot pin 11. As push rod 2 is placed in push rod holes further away from sear bar pivot pin 11, the amount of rotation of the sear bar 3 is lessened and therefore the lock time is reduced accordingly.

Figure 2A:
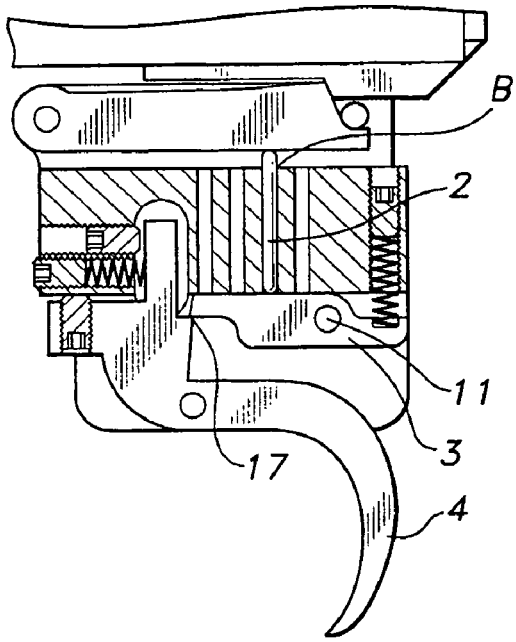
FIG. 2A is side sectional view of an adjustable firearm trigger mechanism according to the present invention in a second configuration with the firing pin in a cocked position.
Figure 2B:
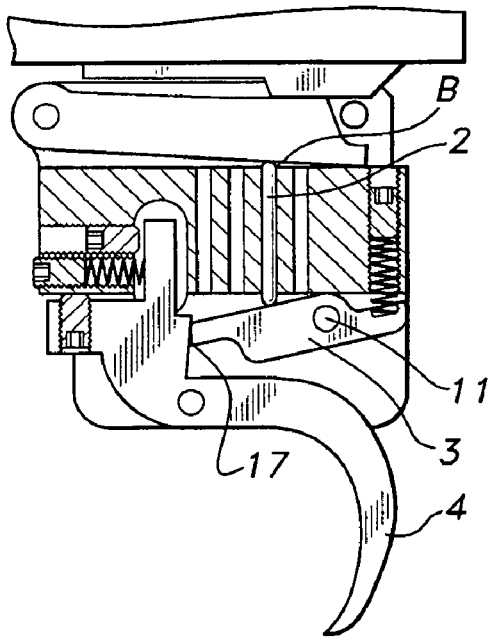
FIG. 2B is side sectional view of an adjustable firearm trigger mechanism according to the present invention in a second configuration with the firing pin in a discharged position.
Figure 3A:
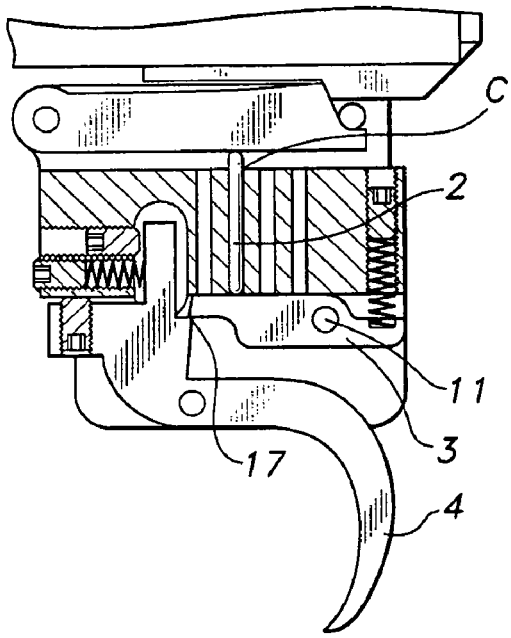
FIG. 3A is side sectional view of an adjustable firearm trigger mechanism according to the present invention in a third configuration with the firing pin in a cocked position.
Figure 3B:
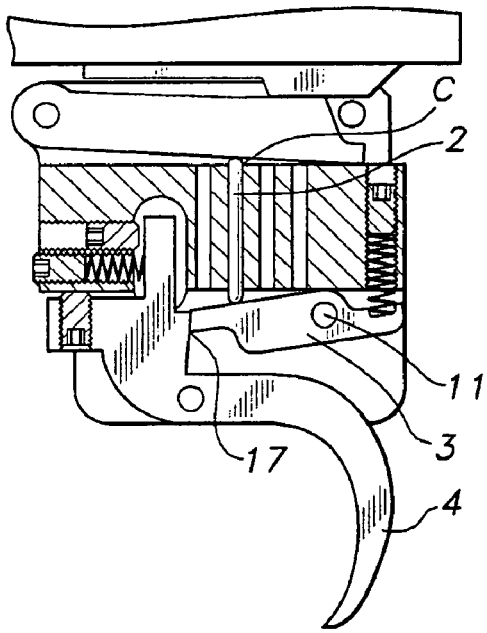
FIG. 3B is side sectional view of an adjustable firearm trigger mechanism according to the present invention in a third configuration with the firing pin in a discharged position.
Figure 4A:
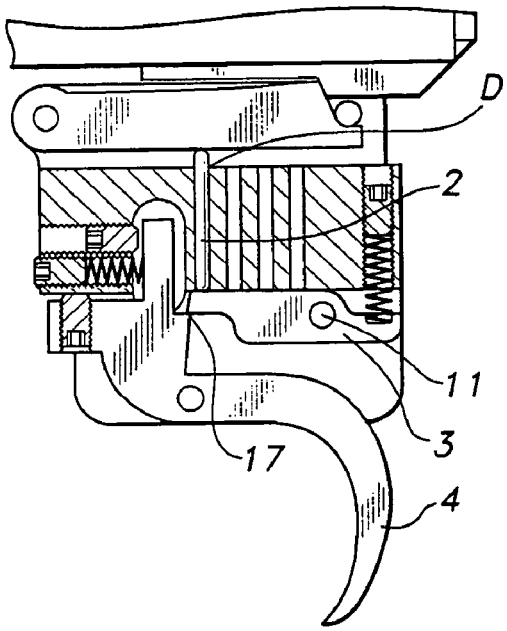
FIG. 4A is side sectional view of an adjustable firearm trigger mechanism according to the present invention in a fourth configuration with the firing pin in a cocked position.
Figure 4B:
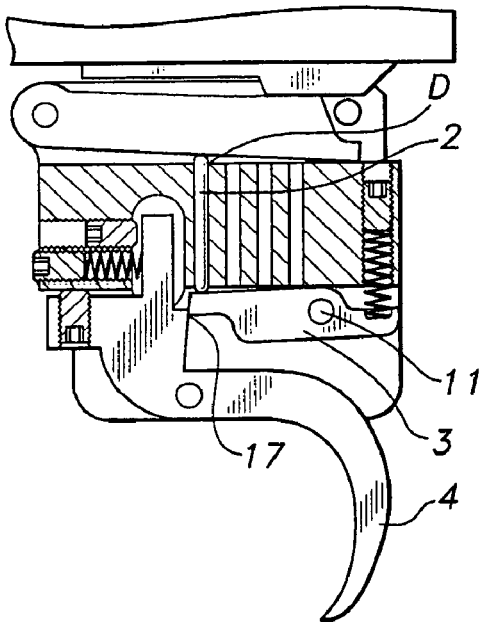
FIG. 4B is side sectional view of an adjustable firearm trigger mechanism according to the present invention in a fourth configuration with the firing pin in a discharged position.

FIGS. 2A and 2B illustrate the push rod 2 placed in push rod hole B. When the trigger shoe 4 is released from the engagement point 17 of sear bar 3, the push rod 2 displaces in a downward direction causing the firing pin block bar 1 to release firing pin cocking piece 13. In this example, the amount of rotation of sear bar 3 is lessened since push rod 2 is placed in push rod hole B, further away from sear bar pivot pin 11. FIGS. 3A and 3B illustrate the push rod 2 placed in push rod hole C. And finally, FIGS. 4A and 4B illustrate the push rod 2 placed in push rod hole D showing the least amount of rotation of sear bar 3 about sear bar pivot pin 11. In this setting, the lock time for the trigger mechanism is the shortest since sear bar 3 rotates the shortest distance to cause push rod 2 to drop the firing pin block bar 1 and release firing pin cocking piece 13.

An additional feature of the invention to adjust the trigger shoe 4 pull force is the inclusion of an adjustable spring mechanism that exerts a return spring force on the sear bar 3. The sear bar 3 has an end opposite sear bar engagement point 17 for receiving sear bar return spring 16. The purpose of sear bar return spring 16 generally is to bias sear bar 3 about sear bar pivot pin 11 into a return position after the rifle action bolt body 14 and firing pin cocking piece 13 of the action has cycled back to a cocked position. By adjusting the spring force of sear bar return spring 16 exerted upon sear bar 3, specifically sear bar engagement point 17, the trigger shoe 4 pull force may be adjusted. A threaded passageway in trigger housing 5 receives a trigger pull adjusting screw 9. Housed within a portion of this threaded passageway is the sear bar return spring 16 abutting the trigger pull adjusting screw 9 on a first end room, and abutting the sear bar 3 on a second end. The force exerted by sear bar return spring 16 upon sear bar 3 can be adjusted by moving the trigger pull adjusting screw 9 within the threaded passageway of trigger housing 5. To lessen the force exerted by sear bar return spring 16, trigger pull adjusting screw 9 may be moved in an upward direction away from the sear bar 3. To increase the force exerted by sear bar return spring 16, trigger pull adjusting screw 9 may be moved in a downward direction, into said threaded passageway toward the sear bar 3.

The advantage of this configuration allows a user to change the compression of sear bar return spring 16 by tightening or loosening trigger pull adjusting screw 9 without having to remove the complete trigger assembly from the firearm. Since the threaded passageway is not blocked by the rear action trigger pin 10, all the user would have to do is remove the firing pin cocking piece 13 and rifle action bolt body 14 from the firearm to access the trigger pull adjusting screw 9 in the threaded passageway. Additionally, sear bar return spring 16 may be replaced with other sear bar return springs of different spring force constants to achieve a user's desired trigger shoe pull force.

It is to be understood that the present invention is not limited to the embodiment described above, but encompasses any and all embodiments within the scope of the following claims.

I claim:

1. An adjustable firearm trigger mechanism for releasably engaging a firing pin cocking piece, comprising:

a firing pin block bar adapted for pivotal movement between a firing pin cocking piece retaining position and a firing pin cocking piece release position;

a trigger shoe pivotally mounted in spaced relationship to said firing pin block bar;

a link mechanism operably interconnecting said trigger shoe and said firing pin block bar, including:

1) a sear bar operably coupled to said trigger shoe at an engagement point for rotation upon pivotal movement of said trigger shoe, said sear bar rotating about a centrally disposed sear bar pivot pin; and 2) a push rod slidably disposed in one of a plurality of push rod holes in a trigger housing between said sear bar and said firing pin block bar, said plurality of push rod holes are disposed between said sear bar engagement point and said sear bar pivot pin defining a first pivoting end of said sear bar.

2. The adjustable firearm trigger mechanism for releasably engaging a firing pin cocking piece of claim 1, further comprising:

a trigger pull adjustment assembly operably disposed between a second pivoting end of said sear bar and said trigger housing, said trigger pull adjustment assembly including.

3. The adjustable firearm trigger mechanism for releasably engaging a firing pin cocking piece of claim 2, further comprising:

a trigger pull adjustment screw mounted in a threaded passage of said trigger housing.

4. The adjustable firearm trigger mechanism for releasably engaging a firing pin cocking piece of claim 2, further comprising:

a sear bar return spring abutting said trigger pull adjustment screw on a first end and said sear bar on a second end.

5. A method of adjusting a firearm trigger mechanism for releasably engaging a firing pin cocking piece, said firearm trigger mechanism including a firing pin block bar adapted for pivotal movement between a firing pin cocking piece retaining position and a firing pin cocking piece release position, a trigger shoe pivotally mounted in spaced relationship to said firing pin block bar, a sear bar operably coupled to said trigger shoe at an engagement point for rotation upon pivotal movement of said trigger shoe, said sear bar rotating about a centrally disposed sear bar pivot pin, a push rod slidably disposed in one of a plurality of push rod holes in a trigger housing between said sear bar and said firing pin block bar, wherein said plurality of push rod holes are disposed between said sear bar engagement point and said sear bar pivot pin, a trigger pull adjustment screw mounted in a threaded passage of said trigger housing, and a sear bar return spring abutting said trigger pull adjustment screw on a first end and said sear bar on a second end, said method comprising the steps of:

inserting said push rod into one of said plurality of push rod holes in said trigger housing; and securing said firing pin block bar to contact a first end of said push rod.

6. The method of adjusting a firearm trigger mechanism for releasably engaging a firing pin cocking piece of claim 5, said method further comprising the steps of:

removing said push rod from one of said plurality of push rod holes in said trigger housing;

inserting said push rod into another of said plurality of push rod holes in said trigger housing; and securing said firing pin block bar to contact said first end of said push rod.

7. The method of adjusting a firearm trigger mechanism for releasably engaging a firing pin cocking piece of claim 5, said method further comprising the steps of:

inserting a sear bar return spring into said threaded passage of said trigger housing.

8. The method of adjusting a firearm trigger mechanism for releasably engaging a firing pin cocking piece of claim 7, said method further comprising the steps of:

adjusting said trigger pull adjustment screw to compress said sear bar return spring against said sear bar.

* * * * *